US006053716A

United States Patent [19]

Riegger et al.

[11] Patent Number: 6,053,716

[45] **Date of Patent: *Apr. 25, 2000**

[54] VANE FOR A ROTARY COMPRESSOR

[75] Inventors: Otto K. Riegger; Robert B. Weatherwax, III, both of Ann Arbor, Mich.

[73] Assignee: Tecumseh Products Company, Tecumseh, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/783,108

[22] Filed: Jan. 14, 1997

[51] Int. Cl.[7] ..... F01C 1/356; F04C 18/356

[52] U.S. Cl. ..... 418/63; 418/152; 418/178; 418/179

[58] Field of Search ..... 418/63, 152, 178, 418/179

[56] References Cited

U.S. PATENT DOCUMENTS

| | | | |
|---|---|---|---|
| Re. 33,919 | 5/1992 | Kristoff et al. | 418/152 |
| 2,905,376 | 9/1959 | Davey | 418/152 |
| 2,925,786 | 2/1960 | Hill | 418/152 |
| 3,512,908 | 5/1970 | Smith | 418/179 |
| 3,658,451 | 4/1972 | Gomada | 418/178 |
| 3,672,798 | 6/1972 | Scherenberg | 418/179 |
| 4,209,286 | 6/1980 | Schwartz | 418/152 |
| 4,490,175 | 12/1984 | Matsuzaki | 418/179 |
| 4,500,360 | 2/1985 | Wakayama et al. | 418/152 |
| 4,570,316 | 2/1986 | Sakamaki et al. | 418/152 |
| 4,615,663 | 10/1986 | Iio et al. | 418/152 |
| 4,616,985 | 10/1986 | Hattori et al. | 418/178 |
| 4,618,317 | 10/1986 | Matsuzaki | 418/63 |
| 4,804,317 | 2/1989 | Smart et al. | 418/152 |
| 4,820,140 | 4/1989 | Bishop | 418/152 |
| 4,859,164 | 8/1989 | Shimomura | 418/179 |
| 5,087,180 | 2/1992 | Clapp | 418/152 |
| 5,090,882 | 2/1992 | Serizawa et al. | 418/63 |
| 5,165,870 | 11/1992 | Sato | 418/178 |
| 5,169,299 | 12/1992 | Gannaway | 418/94 |
| 5,181,844 | 1/1993 | Bishop et al. | 418/152 |
| 5,199,859 | 4/1993 | Kitaichi | 418/179 |
| 5,273,410 | 12/1993 | Kitaichi et al. | 418/178 |
| 5,374,171 | 12/1994 | Cooksey | 418/63 |
| 5,423,664 | 6/1995 | Iizuka et al. | 418/179 |
| 5,494,423 | 2/1996 | Ishiyama et al. | 418/63 |
| 5,516,269 | 5/1996 | Nishioka et al. | 418/179 |
| 5,556,270 | 9/1996 | Komine et al. | 418/179 |
| 5,560,741 | 10/1996 | Edwards | 418/178 |
| 5,591,023 | 1/1997 | Nakamura et al. | 418/179 |

FOREIGN PATENT DOCUMENTS

| | | | |
|---|---|---|---|
| 62-3189 | 1/1987 | Japan | 418/178 |
| 62-26391 | 2/1987 | Japan | 418/179 |
| 62-29782 | 2/1987 | Japan | 418/178 |
| 62-55490 | 3/1987 | Japan . | |
| 62-225790 | 10/1987 | Japan | 418/63 |
| 63-88293 | 4/1988 | Japan . | |
| 2-75786 | 3/1990 | Japan | 418/179 |
| 3-156189 | 7/1991 | Japan | 418/178 |
| 4-124491 | 4/1992 | Japan | 418/63 |
| 7-293464 | 11/1995 | Japan . | |

*Primary Examiner*—John J. Vrablik
*Attorney, Agent, or Firm*—Baker & Daniels

[57] ABSTRACT

Vane for use in a rotary vane compressor or other rotary expansible chamber device and process for making the vane in which the vane comprises a vane body having a first tip, a second tip, and a vane body interconnecting the tips. At least one of the first and second tips comprises a metal alloy and a lubricating agent provided in admixture with the metal alloy. The vane body comprises a metal alloy and a plurality of inorganic particles provided in admixture with the metal alloy. The inorganic particles have a coefficient of thermal expansion which is less than the coefficient of thermal expansion of the metal alloy.

31 Claims, 3 Drawing Sheets

VANE FOR A ROTARY COMPRESSOR

FIELD OF THE INVENTION

This invention relates to vanes of rotary expansible chamber devices, such as rotary compressors, rotating vane compressors, Wankel-type engines and the like in which the vanes are formed from metal alloy composites characterized by improved wear and friction properties. The invention also relates to methods of making such vanes.

BACKGROUND OF THE INVENTION

Rotary compressors have been widely used for compressing refrigerant in refrigeration systems such as refrigerators, freezers, air conditioners, and the like. A typical rotary compressor comprises a housing in which a motor and a compressor cylinder block are disposed. The motor drives a crankshaft for revolving an orbiting piston ("roller") inside a bore of the cylinder. One or more vanes are slidably received in corresponding slots located through the cylinder walls. The vanes separate areas of suction pressure from areas of discharge pressure and, thus, cooperate with the rotor and cylinder wall to provide the structure for compressing refrigerant within the cylinder bore. A representative rotary compressor is described in U.S. Pat. No. 5,374,171, which is incorporated by reference.

One problem encountered with rotary compressors has been the high frictional loading between the vane tip and the roller. To maintain compressor efficiency, the vane has to be highly loaded against the roller in order to prevent refrigerant leakage from high pressure areas to low pressure areas. As a result, the interface between the vane tip and the roller tends to be subject to a substantial amount of friction. If this friction is not minimized, the roller and/or the inner tip may tend to wear out too quickly. This is undesirable, because a compressor having a worn roller or a vane with a worn inner tip may perform poorly. In some instances, if the wear is severe enough, the compressor may not even be operational.

Most commonly, this friction has been controlled by lubricating the interface between the vane tip and the roller with oil. In order for the oil to be distributed to this interface, as well as to other points of the compressor which require lubrication, the oil must have substantial solubility and miscibility with the refrigerant. In this way, as the refrigerant moves through the compressor, the refrigerant carries the oil with it.

Previously, chlorine containing refrigerants and oils compatible with such refrigerants were widely used in rotary compressors. Due to environmental concerns, however, the use of such chorine containing refrigerants will soon be prohibited. As a result, these refrigerants have been replaced by newer, non-chlorine containing refrigerants. Unfortunately, the oils that were used in combination with the chlorinated refrigerants do not have adequate solubility/miscibility with the non-chlorinated refrigerants. This deficiency means that the oil is not carried through the system by the refrigerant, which hinders oil return from the system to the compressor. Effective lubrication cannot be achieved. In order to provide effective lubrication, polyolester oils, which have adequate solubility and miscibility with the newer refrigerants, have been developed and are now currently used in combination with non-chlorinated refrigerants.

The use of the polyolester oils in rotary compressors, however, has been problematic. As one problem, the polyolester oils are not as lubricious as the oils that had been used with the chlorinated refrigerants. Due to such reduced lubricity, the vanes and roller of some rotary compressors may tend to wear at a faster rate when the new refrigerants/polyolester oil combinations are used. Accordingly, it would be desirable to improve the lubrication of such compressors so that the roller and/or vanes show better wear characteristics.

As another drawback, under conditions of excess wear, the refrigerant passages of some rotary compressors may have a tendency to plug up when polyolester oils are used for lubrication. A rotary compressor with plugged up passages not only performs poorly, but also, in many instances, the plugged up passages can damage, or ruin the compressor, requiring costly repair or replacement. Accordingly, it would be desirable to develop an approach that alleviates this problem.

SUMMARY OF THE INVENTION

The present invention provides compressor vanes made from a unique combination of composites which provides the vane tips with excellent lubrication characteristics. These characteristics not only reduce wear and friction of the vane tip, but also of the roller which engages such tip during compressor operation. The vanes of the present invention are particularly advantageous when used in rotary compressors using the newer, less lubricious, polyolester oils and non-chlorine refrigerants. Use of the vanes of the present invention also significantly reduces, and even eliminates, the problem of plugged up refrigerant passages that has occurred in the past from time to time when polyolester oils are used to lubricate rotary compressors. As a result of these advantages, rotary compressors of the present invention are characterized by improved performance and an extended operating life. Vanes of the present invention are particularly well suited for use in rotary compressors of the type described in U.S. Pat. No. 5,374,171, but could also be advantageously used in compressors of the type described in U.S. Pat. No. 5,169,299, incorporated herein by reference.

In one aspect, the present invention provides a vane for an expansible chamber device such as a rotary compressor comprising a first tip, a second tip, and a vane body interconnecting the tips. At least one of the first and second tips comprises a metal alloy and a lubricating agent provided in admixture with the metal alloy. The vane body comprises a metal alloy and a plurality of inorganic particles provided in admixture with the metal alloy. The inorganic particles have a coefficient of thermal expansion which is less than the coefficient of thermal expansion of the metal alloy.

In another aspect, the present invention provides a vane for a rotary compressor comprising a first tip, a second tip, and a vane body interconnecting the tips. The vane body comprises a metal alloy and a plurality of silicon carbide particles provided in admixture with the metal alloy.

In another aspect, the present invention provides a vane in a rotary compressor comprising a first tip, a second tip, and a vane body interconnecting the tips. At least one of the first and second tips comprises a porous carbon preform impregnated with a metal alloy. The vane body comprises a metal alloy and a plurality of silicon carbide particles provided in admixture with the metal alloy.

In another aspect, the present invention provides a process of making a vane for an expansible chamber device such as a rotary compressor. According to the process, an open vane die having a die cavity is provided. The die cavity includes a body cavity section corresponding to the vane body, a first tip cavity section corresponding to a first tip of the vane, and a second tip cavity section corresponding to a second tip of the vane. A preheated, porous carbon preform having a shape corresponding to a tip of the vane is provided in the corresponding tip cavity section of the vane die. The vane die is then closed. A castable admixture comprising a metal alloy and a plurality of inorganic particles provided in admixture with the metal alloy is injected into the closed die cavity. Injection occurs in a manner such that a portion of the admixture containing substantially none of the inorganic particles substantially infiltrates and fills the porous carbon preform, a second portion of the admixture comprising at least a portion of the inorganic particles fills the vane body cavity section, and a third portion of the admixture, which may or may not include the inorganic particles as desired, fills at least a portion of the second tip cavity section. The castable admixture is allowed to solidify, whereby a vane is formed in the die cavity. The resultant vane may then be removed from the die.

BRIEF DESCRIPTION OF THE DRAWINGS

The above-mentioned and other features and advantages of this invention, and the manner of attaining them, will become more apparent, and the invention will be better understood, by reference to the following description of the invention taken in conjunction with the accompanying drawings, wherein.

Corresponding reference characters indicate corresponding parts throughout the drawings. The exemplifications set out herein illustrate representative embodiments of the invention, and such exemplifications are not to be construed as limiting the scope of the invention in any manner.

DETAILED DESCRIPTION OF THE INVENTION

Figure 1:
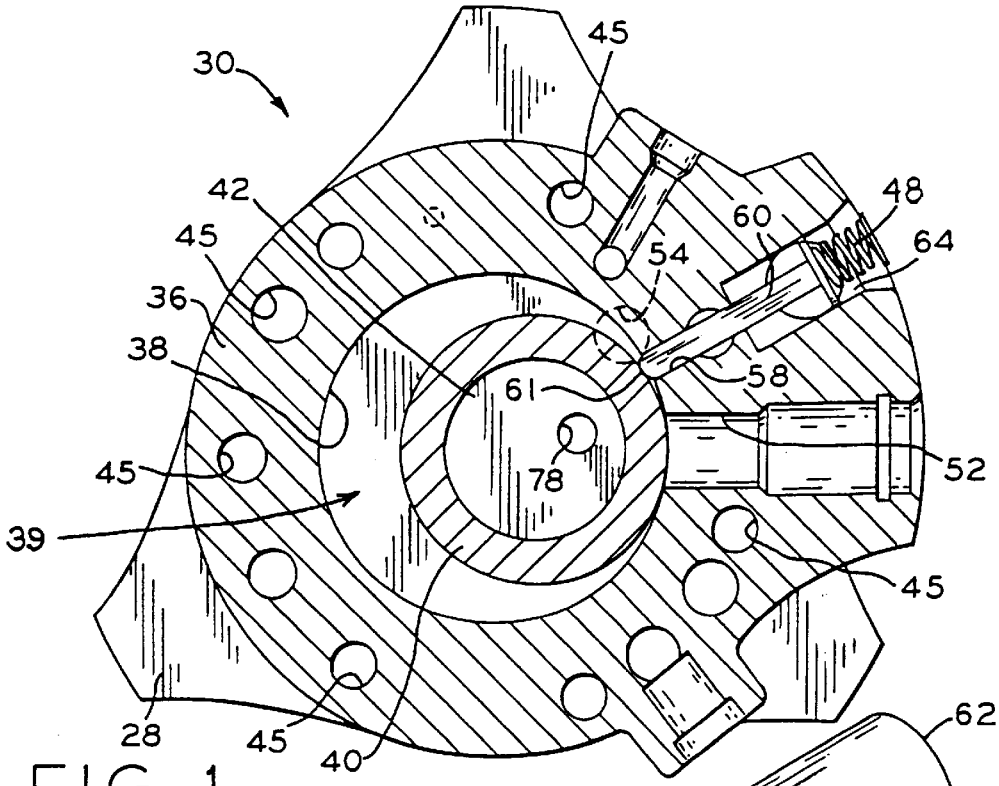
FIG. 1 is a sectional view of a compressor mechanism incorporating a vane of the present invention.

In an exemplary embodiment of one example of an environment for the invention, FIG. 1 shows a sectional view of a compressor mechanism 30 of a rotary compressor of the type described in U.S. Pat. No. 5,374,171, incorporated herein by reference. Compressor mechanism 30 includes a cylinder block 36 which includes cylindrical sidewall 38 defining cylinder bore 39. Vane slot 58 is provided in cylindrical sidewall 38, and sliding vane 60 is received in slot 58. The tip 61 of sliding vane 60 is biased against roller 40 by spring 48 received in spring pocket 64 in order to maintain continuous engagement between tip 61 and roller 40.

Roller 40 is mounted on eccentric portion 42 of the compressor crankshaft (not shown). Eccentric portion 42 includes a recess 78 for receiving washers as described in U.S. Pat. No. 5,374,171, incorporated herein by reference. Compressor mechanism 30 further includes clearance holes 45 which are used to attach compressor mechanism 30 to other parts of the rotary compressor.

As piston roller 40 revolves around bore 39 during compressor operation, refrigerant enters bore 39 through suction port 52. Next, the compression volume enclosed by roller 40, cylinder bore 39, and sliding vane 60 decreases in size as piston roller 40 moves clockwise within bore 39. Refrigerant contained in that volume will therefore be compressed and exit through discharge port 54.

Figure 2:
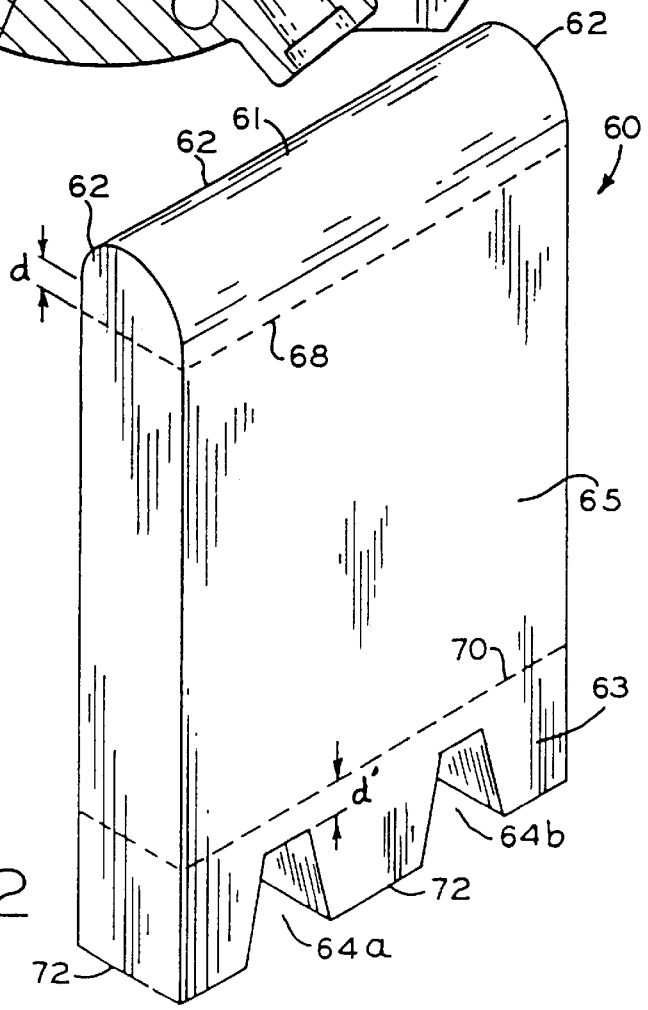
FIG. 2 is a perspective view of a vane of the present invention.

Referring now to FIG. 2, a perspective view of a preferred vane 60 of the present invention is shown. Vane 60 comprises inner tip 61 and outer tip 63. Inner tip 61 includes a machined radius along its outer periphery 62. Outer tip 63 includes spring holding relief recesses 64*a* and 64*b*. Vane body 65 extends between and interconnects tips 61 and 63. As shown in FIG. 2, tips 61 and 63 preferably are integrally formed with vane body 65.

In the practice of the present invention, vane 60 is made from a unique combination of performance enhancing composites. As a first composite, at least one of tips 61 or 63, or both, comprise a composite of a die castable metal or metal alloy (collectively referred to hereinafter as "metal alloy") and a lubricating agent provided in admixture with the metal alloy. Although either tip 61 or 63, or both, may comprise such tip composite, it is preferred that at least tip 61 corresponding to the inner tip of vane 60 includes such composite, because inner tip 61 is the tip which, as it engages the roller during compressor operation, is the primary cause of roller wear.

It is preferred that the tip composite containing the lubricating agent occupy inner tips 61 from at least periphery 62 to boundary 68, which is located in a position on the straight side faces below the machined radius portion of tip 61. The distance between boundary 68 and the end of the machined radius portion of inner tip 61 is denoted as distance d in FIG. 2. Preferably, distance d is about 0.25 inches (0.64 cm). More of vane 60 could be occupied by the tip composite if desired, but additional occupied portions of vane 60 offer little, if any, additional advantage with respect to imparting needed lubricating properties to vane 60. Moreover, additional occupied portions of inner tip 61 may be undesirable in that the strength characteristics of vane 60 may be reduced. Of course, if vane 60 is to be used only in low load applications, occupation of larger portions of vane 60 by the tip composite may be acceptable.

With respect to outer tip 63, it is preferred that the tip composite, when used there, occupy outer tip 63 from peripheral edge 72 to boundary 70, which is preferably positioned such that the entire spring relief recesses 64*a* and 64*b* are fully included within the portion of outer tip 63 which is occupied with the lubricating agent. Preferably, the distance d' between boundary 70 and spring relief recesses 64*a* and 64*b* is about 0.25 (0.64 cm) inches for the reasons described above with respect to the distanced.

The lubricating agent can be any material which, when provided in admixture with the metal alloy, improves the lubricating characteristics of the alloy. Preferably, the lubricating agent is of a type capable of withstanding sufficiently high temperatures without breaking down or volatilizing in order to allow the lubricating agent to be incorporated into the composite when the metal alloy is in the molten state.

Representative examples of lubricating agents which meet this preferred criteria and which are suitable in the practice of the present invention include graphite, carbon, and the like.

The lubricating agent may be provided in a variety of forms and still be within the scope of the present invention. As alternatives, the lubricating agent can be provided in the form of a powder, as fibers, as a porous preform, and the like. Preferably, the lubricating agent is provided as a porous carbon preform, and the metal alloy substantially infiltrates and fills the preform. In embodiments of the present invention in which the lubricating agent is provided as a porous carbon preform to be disposed in inner tip 61 and/or outer tip 63, it is preferred that the preform has a shape corresponding to the shape of the tip 61 and/or tip 63, as appropriate.

In particularly preferred embodiments of the present invention, the lubricating agent is provided as a porous carbon preform which is machined from commercially available porous carbon material, which is typically available in the form of a block. Advantageously, incorporation of such a carbon preform into tip 61, tip 63 or both, as the case may be, provides long-lasting lubricating protection not only for the tips 61 and/or 63, but also for the roller 40 (FIG. 1) which engages the tips 61 and 63 during compressor operation. This, in turn, extends the useful operating life of the compressor.

Incorporation of a carbon preform into a vane tip is particularly advantageous in use with rotary compressors using the newer, less lubricious, polyolester oils and non-chlorinated refrigerants. For example, a vane of the present invention incorporating a porous carbon preform impregnated with an aluminum alloy was tested for 500 continuous hours in a rotary compressor using 407A refrigerant lubricated with polyolester oil and operating at a 435 psig discharge pressure and a 28 psig suction pressure. After, the test was completed, the amount of iron dissolved in the oil was used to quantify roller wear. Surprisingly, hardly any roller wear could even be detected, as only 16 ppm of iron was dissolved in the oil. In contrast, use of a conventional ferrous powder metal vane under otherwise the same testing conditions resulted in substantially more roller wear, as evidenced by a concentration of 240 ppm of iron dissolved in the oil. In another 500 hour test of a rotary compressor using 410A refrigerant and polyolester oil and operating at 539 psig discharge pressure and 79 psig suction pressure, the amount of iron dissolved in the oil was only 9 ppm for an embodiment of the present invention as compared to 210 ppm for a compressor using the conventional vane.

As another advantage, the use of a carbon preform also substantially reduces, and even can eliminate, the problem of plugged up refrigerant passages that had, until now, been a problem in rotary compressors using polyolester oil. While not wishing to be bound by theory, it is believed that the improved lubrication provided by the carbon preform is responsible for solving this problem. For example, in the absence of the carbon preform, the roller of some compressors may suffer from high wear when the interface between the roller and a vane tip is lubricated only with polyolester oil. As the roller wears, iron debris is released from the roller and then is carried by the polyolester oil into the refrigerant passages. There may be so much of the debris, that the debris plugs the passages. In contrast, when carbon preform is used, lubrication is so dramatically improved that there is very little wear of the roller. As a result, the amount of iron debris carried away by the oil is so small that plugging does not occur.

In selecting a porous carbon material suitable for use in practicing the present invention, it is preferred to use porous carbon material having a mesh porosity which facilitates infiltration of the resultant preform by the metal alloy when vane 60 is made using the die casting process described below. If the mesh porosity is too low, it may be difficult to achieve infiltration. On the other hand, if the mesh porosity is too high, infiltration might be easier to achieve, but the lubricating characteristics of the preform may be reduced because less lubricating agent would be present at the surface of the vane tip. More importantly, in those embodiments of the invention in which a castable admixture of molten metal alloy and inorganic particles is used to form the vane 60 as described below, it is also desirable that the mesh porosity of the porous carbon be sufficiently low such that the inorganic particles are unable to infiltrate the preform. It is undesirable to allow the inorganic particles, which tend to be abrasive, to be present in the preform, because the resultant tip 61 and/or 63, as the case may be, would tend to abrade compressor parts coming into contact with such tip.

For example, when an admixture of an aluminum alloy and silicon carbide particles which is commercially available as Duralcan from Alcan Aluminum Limited is used for making the vane 60, it has been found that porous carbon blocks having a density of about 0.8 to about 1.0 g/cm$^3$ are characterized by a mesh porosity suitable in the practice of the present invention. Carbon preforms prepared from such blocks have a mesh porosity which allows the aluminum alloy to infiltrate, yet the porosity of such blocks is low enough to prevent substantially all of the silicon carbide particles from entering the preform during infiltration.

In preferred embodiments, the porous carbon material is manufactured using a sintering process in which a stack of layers of a suitable fabric, such as rayon fabric, is first pyrolized to carbonize and fuse the layers. Pyrolization is followed by a process which adds additional carbon in order to achieve desired density characteristics. A representative example of a commercially available sintered carbon block suitable in the practice of the present invention and having a density of about 0.8 to about 1.0 g/cm$^3$ is commercially available from Specialty Minerals.

Figure 3:
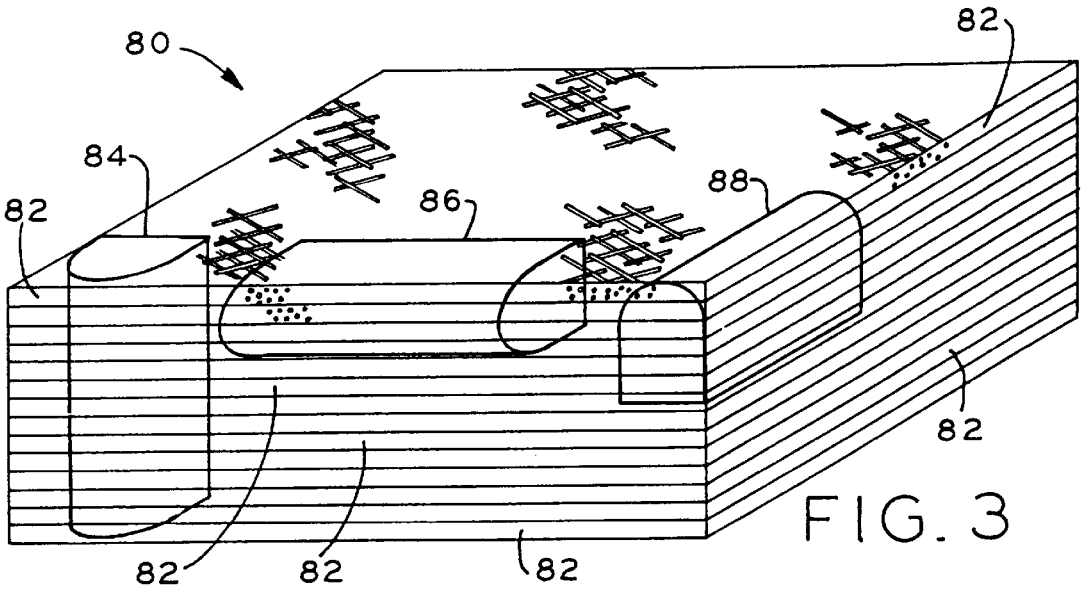
FIG. 3 is a schematic perspective view of a porous carbon block suitable in the practice of the present invention.

A representative block 80 of sintered, porous carbon is shown in FIG. 3. Because of the manner in which the carbon block 80 is formed from a plurality of fabric layers, block 80 comprises a plurality of corresponding layers 82. Layers 82 impart a grain effect to block 80 which is very analogous to the grain of a piece of wood. Just as a part can be machined from wood in a manner such that the wood grain is oriented in a particular direction in the resultant part, preferred porous carbon preforms of the present invention may be machined from block 80 in a manner such that the orientation of layers 82 in the resultant preform enhances the performance and/or manufacturability of the vane into which the preform is incorporated. Preforms may be machined from block 80 in a variety of ways depending upon the desired orientation of layers 82 in such preforms. Preforms 84, 86, and 88 are examples of three different ways in which preforms can be machined from block 80. For purposes of illustration, preforms 84, 86, and 88 are configured to be disposed in the inner tip of a vane, but corresponding preforms configured to be disposed in the outer tip of a vane could be machined from block 80 in an analogous fashion.

Figure 4A:
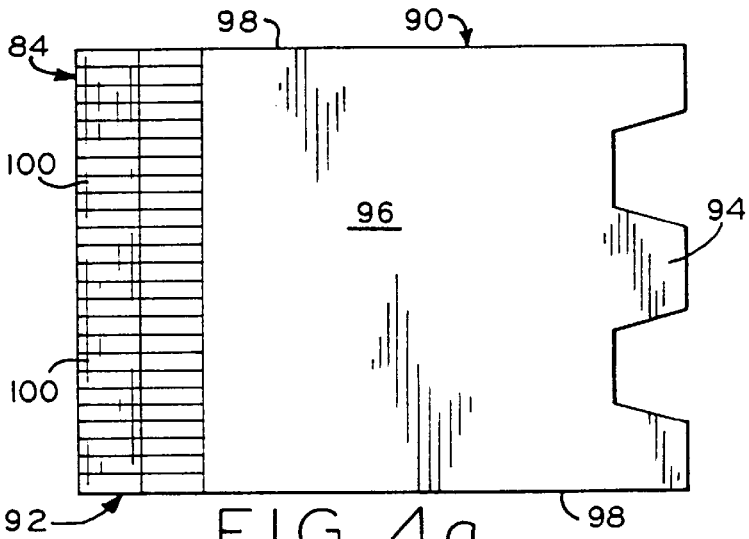
FIG. 4*a* is a schematic side view of a vane of the present invention incorporating a porous carbon preform and showing a preferred grain orientation.
Figure 4B:
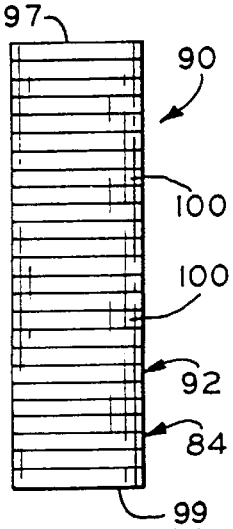
FIG. 4*b* is a schematic front view of the vane of FIG. 4*a;*
Figure 4C:
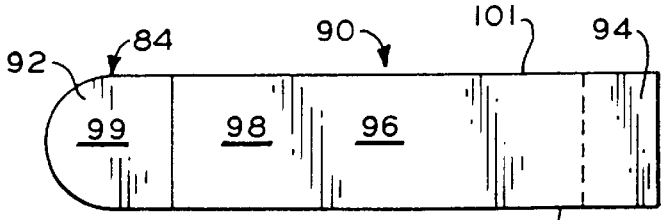
FIG. 4*c* is a schematic top view of the vane of FIG. 4*a;*

The result of incorporating preform 84 into a vane will be described with reference to FIGS. 4*a*, 4*b*, and 4*c*. As shown in these Figures, vane 90 includes inner tip 92, outer tip 94, and a vane body 96 interconnecting tips 92 and 94. Vane 90 is generally planar in shape having a longitudinal axis that extends from tip 92 to tip 94, and includes planar side faces 101 and edge faces 98. Preform 84 includes layers 100 and is disposed in inner tip 92 such that layers 100 are stacked in a direction from one edge 97 of the preform to the other edge 99. The grain orientation extends parallel to the longitudinal axis and parallel to a plane normal to the plane of the vane, that is, normal to side faces 101. Such alignment makes it easy for the molten metal alloy to infiltrate and fill the preform during the die casting process as it flows parallel to such grain orientation. Such alignment also reduces the tendency of the preform to peel during compressor operation.

Figure 5A:
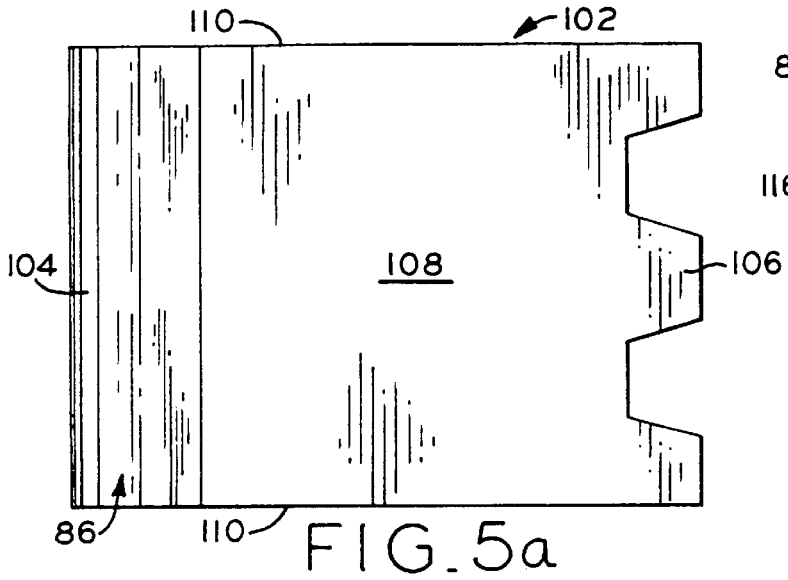
FIG. 5*a* is a schematic side view of a vane of the present invention incorporating a porous carbon preform.
Figure 5B:
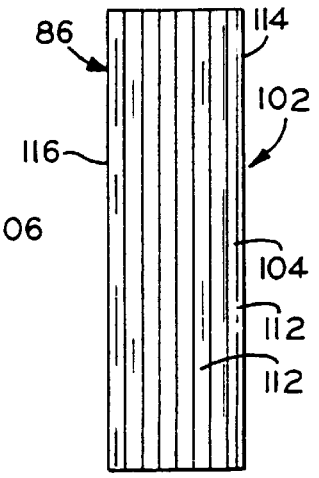
FIG. 5*b* is a schematic front view of the vane of FIG. 5*a;*
Figure 5C:
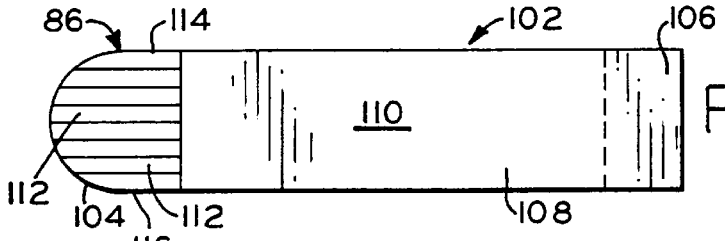
FIG. 5*c* is a schematic top view of the vane of FIG. 5*a;*

The result of incorporating preform 86 into a vane will be described with reference to FIGS. 5*a*, 5*b*, and 5*c*. As shown in these Figures, vane 102 includes inner tip 104, outer tip 106, and a vane body 108 interconnecting tips 104 and 106. Vane 102 includes edge faces 110. Preform 86 includes layers 112 and is disposed in inner tip 104 such that layers 112 are stacked in a direction from the side face 114 of the preform to opposite side face 116. With this kind of alignment, layers 112 act like wipers as inner tip 104 engages the roller of a compressor. Such alignment not only reduces roller wear, but also allows the molten metal alloy to easily infiltrate and fill the preform during the die casting process.

Figure 6A:
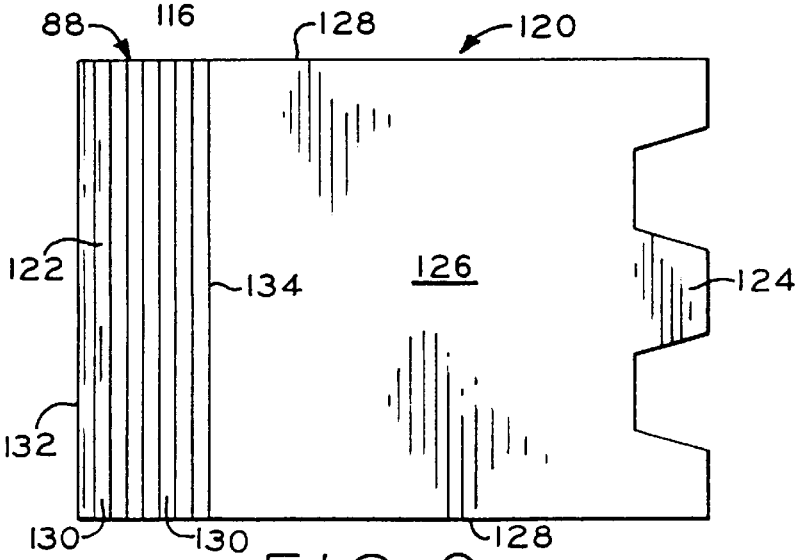
FIG. 6*a* is a schematic side view of a vane of the present invention incorporating a porous carbon preform.
Figure 6B:
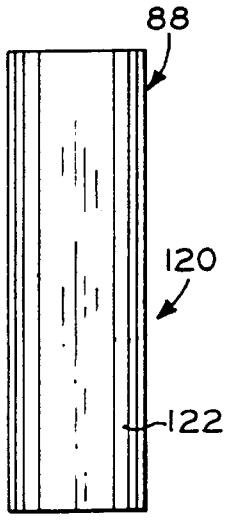
FIG. 6*b* is a schematic front view of the vane of FIG. 6*a*.
Figure 6C:
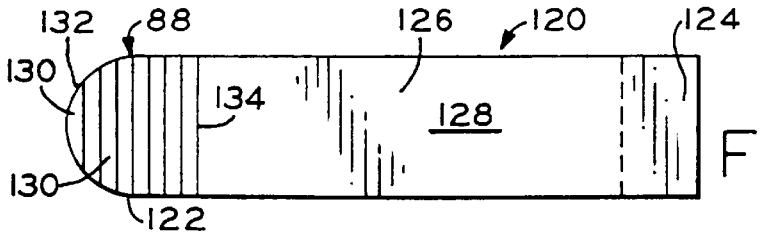
FIG. 6*c* is a schematic top view of the vane of FIG. 6*a*.

The result of incorporating preform 88 into a vane will be described with reference to FIGS. 6*a*, 6*b*, and 6*c*. As shown in these Figures, vane 120 includes inner tip 122, outer tip 124, and a vane body 126 interconnecting tips 122 and 124. Vane 120 includes edge faces 128. Preform 88 includes layers 130 and is disposed in inner tip 122 such that layers 130 are stacked in a direction from the front 132 of the preform to the back 134.

Referring again to FIG. 2, metal alloys suitable for use in the tip composite used in tip 61, tip 63, or both, may be any metal, metal alloy, or combination thereof known to be suitable for fabricating durable compressor parts. In preferred embodiments of the invention, the metal used in the tip composite is an aluminum alloy. Aluminum alloys enjoy a combination of light weight and strength which makes such alloys extremely well suited for fabricating vanes of the present invention.

In particularly preferred embodiments, the metal alloy of the first composite is an aluminum alloy, and the lubricating agent is a porous carbon preform. Advantageously, a composite comprising a combination of a porous carbon preform and an aluminum alloy has a coefficient of thermal expansion which is substantially the same as that of a cylinder block made from cast iron. As a result, when a vane tip comprising such a composite is used in a cast iron cylinder block, the tolerances between the tip and the block are extremely stable over a wide range of operating temperatures.

In contrast, metal alloys, and in particular aluminum alloys, by themselves may be characterized by a coefficient of thermal expansion which is generally higher than that of the cast iron materials typically used to form the cylinder block which slidably houses the vanes. Vanes made only from such alloys will tend to expand and contract to a much greater extent with changes in temperature than the cast iron cylinder block. This makes it quite difficult to maintain tolerances between the vanes and the block, because compressor temperatures can vary over a wide temperature range, particularly after a cold compressor is started and warms up.

Still referring to FIG. 2, vane 60 could be made entirely from only a composite of a porous carbon preform substantially infiltrated and filled with a metal alloy such as an aluminum alloy. Such a construction may have excellent lubricating characteristics, but may tend to be too weak to withstand relatively high compressor pressures without fracturing. Accordingly, to provide vane 60 with desired strength characteristics, vane body 65 of vane 60 preferably includes a vane body composite comprising a metal alloy and a plurality of inorganic particles provided in admixture with the metal alloy, wherein the coefficient of thermal expansion of the inorganic particles is less than the coefficient of thermal expansion of the metal alloy. Including such particles in the composite reduces the coefficient of thermal expansion of the resultant composite such that the coefficient of thermal expansion of the composite is closer to that of the cylinder block. Use of such inorganic particles may not be required in embodiments of the invention in which the coefficients of thermal expansion of the vane 60 and the corresponding cylinder block are sufficiently close to maintain functional tolerances during compressor operation.

A wide variety of inorganic particles would be suitable in the practice of the present invention, depending upon the kind of metal alloy used to form the vane body 65. Representative examples of such particles would include particles comprising titanium oxide, zinc oxide, tin oxide, aluminum oxide, bentonite, kaolin, silicon carbide, iron oxide, silicon oxide, oxides of metal alloys, and the like. Of these, silicon carbide particles are most preferred.

Inorganic particles suitable in the practice of the present may have any of a variety of shapes. For example, such particles can be spheroids, ellipsoids, elongate particles, irregular-shaped particles, or the like. Of these shapes, it is believed that the smoother shapes, such as the spheroids or ellipsoids, would be more desirable in that such smoother particles would be less abrasive with respect to machining and wear considerations than more irregularly-shaped particles.

Inorganic particles of the present invention may also be characterized by a particle size selected from a wide range of suitable sizes. However, the particle size should not be selected to be so small that the inorganic particles are able to infiltrate the carbon preform in those embodiments in which a carbon preform is used. On the other hand, the particle size of the inorganic particles should not be so large that manufacturability of the vane is adversely effected to too great a degree. As an example, in embodiments of the present invention in which an irregularly-shaped silicon carbide particles are used as the inorganic particles, an average particle size of 0.00029 inches (0.00074 cm) with a range from 0.0001 inches (0.0025 cm) to 0.0005 inches (0.0013 cm) has been found to be suitable in the practice of the present invention.

Preferably, an amount of the inorganic particles is used in the vane body composite which balances the need to reduce the coefficient of thermal expansion of the metal alloy with the need to maintain the manufacturability and performance of the vane 60. For example, if too little of the inorganic particles is used, the reduction in the coefficient of thermal expansion of the metal alloy may be too insubstantial. On the other hand, using too much of the particles may adversely effect the flowability of the aluminum alloy in the molten state, making it more difficult to manufacture vane 60 using casting processes such as the casting process described below. Using too much of the particles may also increase the wear of the cylinder block by the vane (FIG. 1) and may also make it difficult to machine vane 60. Using too much of the particles may also cause tooling to wear out too quickly, or may tend to reduce the strength of vane 60.

Generally, in embodiments of the invention comprising silicon carbide particles, using 0.1 to 50, preferably 5 to 40, and more preferably 15 to 30, and most preferably about 20 parts by weight of the silicon carbide particles with respect to 100 parts by weight of the composite would be suitable in the practice of the present invention.

Metal alloys suitable for use in the vane body composite may be any metal, metal alloy, or combination thereof known to be suitable for fabricating durable compressor parts. Such metal alloy may be the same or different than the metal alloy used in the tip composite. In preferred embodiments of the invention, the metal alloy used in the vane body composite is an aluminum alloy, and preferably is the same aluminum alloy used in the tip composite. Using the same alloy for both composites allows vanes of the present invention to be easily made using the die casting process described below. In particularly preferred embodiments of the invention, the metal alloy of the vane body composite comprises an aluminum alloy, and the inorganic particles comprise silicon carbide particles.

In addition to inorganic particles and the metal alloy, the vane body composite may optionally include other additives in accordance with conventional practices. For example, the vane body composite may include an effective amount of an additive that makes the metal alloy flow better during casting process. As another option, the alloy may include an additive that reduces the tendency of the alloy to shrink as it solidifies. As another option, the alloy may also include an additive which improves the wear resistance of the alloy. Such adjuvants are well known, and examples include silicon, copper and the like.

An example of an admixture of an aluminum alloy and silicon carbide particles suitable in the practice of the present invention is commercially available as Duralcan from Alcan Aluminum Limited. This product contains about 20 parts by weight of silicon carbide particles and about 80 parts by weight of aluminum alloy based upon about 100 parts by weight of the admixture. The particles in this product are irregularly shaped polygons. In addition to the aluminum alloy and the silicon carbide particles, the aluminum alloy of the admixture also includes silicon, copper, and other trace elements.

According to one approach for making a preferred embodiment of vane 60 of the present invention which uses die casting techniques, a vane die is provided which has a die cavity corresponding to vane 60 to be produced. The die cavity, therefore, includes a first tip cavity section corresponding to first tip 61 of vane 60, a second tip cavity section corresponding to second tip 63 of vane 60, and a body cavity section corresponding to vane body 65 of vane 60.

A preheated, porous carbon preform which has a shape and volume corresponding to that of the corresponding vane tip is then provided in a corresponding tip cavity of the die. If a preform is to be incorporated into both of the vane tips, then a corresponding pair of preforms, rather than just a single preform, would be provided. Each such preform is preheated to a temperature which is sufficiently high to allow the metal alloy to infiltrate and fill the carbon preform. If the temperature of the carbon preform is too cool, the metal alloy may not adequately infiltrate and fill the preform. On the other hand, there is no need to preheat the preform to a temperature that is hotter than is required to allow infiltration. Further, if the temperature of the carbon preform is too hot, the carbon preform could break down. Generally, heating the carbon preform to a glowing orange color believed to be about 1000° F. (540° C.) has been found to be suitable in the practice of the present invention. After the preheated carbon preform, or pair of preforms, is provided in the die cavity, the die is then closed.

Next, a castable admixture comprising the molten metal alloy and a plurality of inorganic particles is injected into the die cavity under pressure using, for example, squeeze casting techniques. The admixture desirably is injected into the die cavity at a temperature hot enough to ensure that the metal alloy is in the molten state. In some embodiments, it may be acceptable if the inorganic particles melt as well. However, it is more preferred that the inorganic particles remain as solid particles so that such materials do not infiltrate the preform. Accordingly, the temperature preferably should not be so hot that the inorganic particles melt or break down. Generally, injecting into the cavity an admixture comprising an aluminum alloy and silicon carbide particles at a melt temperature in the range from 1,250° F. (680° C.) to 1,350° F. (730° C.), more preferably about 1,350° F. (730° C.), would be suitable in the practice of the present invention.

During injection of the castable admixture of the molten metal alloy and the inorganic particles, the admixture fills the section of the die cavity not occupied by the carbon preform. In such regions, the resulting vane will comprise a composite comprising both the metal alloy and the inorganic particles. In the regions of the die cavity occupied by a carbon preform, the metal alloy, but not the inorganic particles, infiltrates and fills the preform to provide a composite of the alloy and the carbon preform. When a carbon preform of appropriate density is used as is described above, the inorganic particles cannot enter the preform because they are too big and will advantageously be excluded from those regions.

After the admixture of the metal alloy and the inorganic particles is injected into the die cavity, the contents of the die cavity are cooled. The metal alloy will solidify during cooling. In embodiments in which the inorganic particles were also in the molten state, the inorganic particles will solidify as well. During the period in which the metal alloy and the particles, if appropriate, are solidifying during cooling, pressure is maintained on the die cavity so that, if any shrinkage of the die contents occurs during cooling, additional feed material will enter and fill any voids resulting from such shrinkage. After solidification is complete, the finished vane is removed from the die.

The present invention will now be further described with respect to the following example.

EXAMPLE

A die was provided which included a gate located in a portion of the die corresponding to the center of the vane body. Vents were also provided in each corner of the vane cavity in order to allow air to vent from the cavity and to allow for cold metal runout. The die was preheated in a press to 525° F. (274° C.). In the meantime, a composite comprising an aluminum alloy and silicon carbide particles (Duralcan composite commercially available from Alcan Aluminum Limited) was heated to 1350° F. (730° C.) and maintained at that temperature with a cover of argon gas in order to prevent oxide formation. Under these conditions, the aluminum alloy, but not the silicon carbide particles, melted. The die cavity was then removed from the press and a porous carbon preform corresponding in shape to the inner tip of the vane to be produced was placed in position in the die cavity. Standoffs were provided in the upper and lower portions of the die in order to prevent intimate contact between the preform and the die so that molten aluminum would be able to flow around the preform. The carbon preform, and consequently the surrounding die cavity, were heated using an oxyacetylene torch until the preform was orange in color. At this time, the composite comprising molten aluminum alloy and silicon carbide particles was poured into the holding chamber of the press below the die position. The die was then closed and replaced into the press. After this, the die was plunged into the holding chamber and held under a working pressure of 2400 psi. The composite flowed into the die cavity under the pressure such that infiltration of the preform and solidification of the molten aluminum alloy occurred, a process which took less than 5 seconds. After solidification, the pressure was released and the resultant vane was removed from the cavity. The vane is then machined to its final dimensions.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vane for a rotary expansible chamber device, comprising a first tip, a second tip, and a vane body interconnecting said first and second tips, wherein:

at least one of said first and second tips comprises a first metal alloy and a lubricating agent provided in admixture with said first metal alloy; and the vane body comprises a second metal alloy and a plurality of inorganic particles provided in admixture with said second metal alloy, wherein said vane body admixture has a coefficient of thermal expansion which is less than the coefficient of thermal expansion of said second metal alloy, and said at least one tip is substantially devoid of said inorganic particles.

2. The vane of claim 1 wherein said at least one tip includes an arcuate end portion joined to straight side walls, and said tip admixture extends from said arcuate end portion beyond where said end portion joins the straight side walls.

3. The vane of claim 1 wherein said lubricating agent is selected from the group consisting of carbon and graphite.

4. The vane of claim 1 wherein the vane body admixture comprises an aluminum alloy and silicon carbide particles.

5. The vane of claim 1, wherein said lubricating agent is a porous carbon preform and said preform is impregnated with said metal alloy.

6. The vane of claim 1 wherein said vane body comprises said metal alloy and said organic particles are silicon carbide particles.

7. The vane of claim 1, wherein said first and second metal alloys are the same.

8. The vane of claim 1 wherein said inorganic particles have a coefficient of thermal expansion which is less than the coefficient of thermal expansion of said second metal alloy.

9. The vane of claim 1, wherein said lubricating agent is oriented in layers having a grain orientation.

10. The vane of claim 9 wherein said vane is generally planar and has a longitudinal axis extending from said first tip to said second tip, and said grain orientation runs parallel to said axis.

11. The vane of claim 10 wherein said grain orientation also runs parallel to a plane normal to the plane of said vane.

12. The vane of claim 1 wherein said inorganic particles are selected from the group consisting of titanium oxide, zinc oxide, tin oxide, aluminum oxide, bentonite, kaolin, silicon carbide, iron oxide, silicon oxide and oxides of metal alloys.

13. The vane of claim 12, wherein said lubricating agent is a porous carbon preform and said preform is impregnated with said metal alloy.

14. A rotary compressor comprising a cylinder, a roller and a vane in engagement with said roller, said vane comprising a first tip, a second tip, and a vane body interconnecting said first and second tips, wherein:

at least one of said first and second tips comprises a first metal alloy and a lubricating agent provided in admixture with the metal alloy; and the vane body comprises a second metal alloy and a plurality of inorganic particles provided in admixture with said second metal alloy, wherein said vane body admixture has a coefficient of thermal expansion which is less than the coefficient of thermal expansion of said second metal alloy, and said at least one tip is substantially devoid of said inorganic particles.

15. The compressor of claim 14, wherein said lubricating agent is a porous carbon preform and said preform is impregnated with said first metal alloy.

16. The rotary compressor of claim 14, wherein said first and second metal alloys are the same.

17. The rotary compressor of claim 14 wherein said inorganic particles have a coefficient of thermal expansion which is less than the coefficient of thermal expansion of said second metal alloy.

18. The compressor of claim 14, wherein said lubricating agent is oriented in layers having a grain orientation, said vane is generally planar and has a longitudinal axis extending from said first tip to said second tip, and said grain orientation runs parallel to said axis.

19. The compressor of claim 18 wherein said grain orientation also runs parallel to a plane normal to the plane of said vane.

20. The compressor of claim 14 wherein said inorganic particles are selected from the group consisting of titanium oxide, zinc oxide, tin oxide, aluminum oxide, bentonite, kaolin, silicon carbide, iron oxide, silicon oxide and oxides of metal alloys.

21. The compressor of claim 20, wherein said lubricating agent is a porous carbon preform and said preform is impregnated with said first metal alloy.

22. A vane for a rotary expansible chamber device, comprising a first tip, a second tip, and a vane body interconnecting said first and second tips, wherein:

at least one of said first and second tips comprises a porous carbon preform impregnated with a metal alloy; and the vane body comprises said metal alloy and a plurality of silicon carbide particles provided in admixture with the metal alloy, said at least one tip substantially devoid of said silicon carbide particles.

23. The vane of claim 22 wherein said lubricant is oriented in layers having a grain orientation, said vane is generally planar and has a longitudinal axis extending from said first tip to said second tip, and said grain orientation runs parallel to said axis.

24. The vane of claim 22 wherein said preform comprises a plurality of carbon fabric layers.

25. The vane of claim 22 wherein the silicon carbide particles are about 0.1 to 50 parts by weight with respect to 100 parts by weight of the admixture of metal alloy and silicon carbide particles.

26. The vane of claim 22 wherein the silicon carbide particles are about 5 to 40 parts by weight with respect to 100 parts by weight of the admixture of metal alloy and silicon carbide particles.

27. The vane of claim 22 wherein the silicon carbide particles are about 15 to 30 parts by weight with respect to 100 parts by weight of the admixture of metal alloy and silicon carbide particles.

28. A vane for a rotary expansible chamber device, comprising a first tip, a second tip, and a vane body interconnecting said first and second tips, wherein:

the vane body comprises a metal alloy and a plurality of silicon carbide particles provided in admixture with the metal alloy; and at least one of said first and second tips is substantially devoid of silicon carbide particles.

29. A vane for a rotary expansible chamber device, comprising a first tip, a second tip, and a vane body interconnecting said first and second tips, wherein:

the vane body comprises a metal alloy and a plurality of inorganic particles provided in admixture with said metal alloy; and at least one of said first and second tips comprises said metal alloy and a porous filter material through which said inorganic particles cannot pass.

30. The vane of claim 29, wherein said filter is a porous preform, and said metal alloy infiltrates said preform.

31. The vane of claim 30, wherein said preform is made of carbon.

* * * * *